United States Patent [19]

Buhrer

[11] Patent Number: 4,587,462

[45] Date of Patent: May 6, 1986

[54] FLUORESCENT LIGHT SOURCE WITH PARALLEL DC DISCHARGES

[75] Inventor: Carl F. Buhrer, Framingham, Mass.

[73] Assignee: GTE Laboratories Incorporated, Waltham, Mass.

[21] Appl. No.: 639,916

[22] Filed: Aug. 10, 1984

[51] Int. Cl.[4] ..... H05B 41/16; H05B 41/24

[52] U.S. Cl. ..... 315/260; 313/581; 313/609; 313/493; 315/278; 315/334; 315/323; 315/279

[58] Field of Search ..... 313/609, 610, 493, 581; 315/260, 267, 219, 334, 323, 169.3, 287, 278, 279

[56] References Cited

U.S. PATENT DOCUMENTS

| | | | |
|---|---|---|---|
| 1,963,962 | 6/1934 | Barclay | 313/610 X |
| 1,992,493 | 2/1935 | Los | 250/27.5 |
| 2,561,868 | 7/1951 | Jenkins et al. | 313/610 |
| 2,624,866 | 1/1953 | Reeves | 315/167 X |
| 2,892,125 | 6/1959 | Warner et al. | 315/323 |
| 3,117,248 | 1/1964 | Lake | 313/187 |
| 3,194,997 | 7/1965 | Waly | 313/109 |
| 3,501,662 | 3/1970 | Plagge | 313/109 |
| 3,508,103 | 4/1970 | Young | 313/109 |
| 3,526,802 | 9/1970 | Wainio | 313/109 |
| 3,609,436 | 9/1971 | Campbell | 313/204 |
| 3,849,689 | 11/1974 | Campbell | 313/610 |
| 4,128,788 | 12/1978 | Lowther | 315/167 |
| 4,142,125 | 2/1979 | Lauwerijssen et al. | 313/485 |
| 4,182,975 | 1/1980 | Young | 313/485 |
| 4,184,101 | 1/1980 | Young | 313/485 |
| 4,185,221 | 1/1980 | Young | 313/485 |
| 4,187,446 | 2/1980 | Gross et al. | 315/58 |
| 4,191,907 | 3/1980 | Rogoff | 313/204 |
| 4,260,931 | 4/1981 | Wesselink et al. | 313/493 |
| 4,272,703 | 6/1981 | Eckberg | 315/205 |
| 4,281,271 | 7/1981 | Young et al. | 313/493 |
| 4,286,190 | 8/1981 | Young et al. | 313/493 |
| 4,300,073 | 11/1981 | Skwirut et al. | 315/53 |
| 4,337,414 | 6/1982 | Young | 315/56 |
| 4,445,069 | 4/1984 | Van Amstel | 313/610 |

*Primary Examiner*—Saxfield Chatmon

*Attorney, Agent, or Firm*—Hamilton, Brook, Smith & Reynolds

[57] ABSTRACT

A fluorescent light source and power supply adapted therefore in which a set of three D.C. mercury discharge paths are provided adjacent each other in a single tubular envelope. A cathode is provided at the base end of each path and a single anode at the other end. The three discharge paths are isolated longitudinally extended semi-circular glass insulator partitions. The power supply provides D.C. voltage across the anode and cathodes and a switching circuit which transfers energy from a transformer during portions of the switching cycle to efficiently power the tube.

15 Claims, 6 Drawing Figures

FLUORESCENT LIGHT SOURCE WITH PARALLEL DC DISCHARGES

DESCRIPTION

1. Technical Field

This invention relates to electric discharge lamps and, in particular, to fluorescent lamps and power sources therefor.

2. Background Art

The usual fluorescent light source, or lamp, consists of a long glass tube that is coated with light emitting material, such as phosphor, on its internal surface and filled with a mixture of inert gases and mercury vapor. Two heated tungsten filaments at opposite ends of the tube conduct current into a low-pressure mercury-vapor discharge that emits 2537 A radiation which is converted to visible light by the phosphor. A fluorescent lamp is a much more efficient producer of light than an incandescent lamp, but remains limited to applications where its length can be accommodated. Various means of compacting the basic straight tubular lamp have been tried, the most familiar being the commercially available circular fluorescent lamp.

Most fluorescent lamps are made from glass tubing with a discharge tube diameter of 25 or 38 mm. As the diameter of a discharge tube is made larger, efficiency is reduced, since less of the 2537 A ultraviolet light produced reaches the phosphor coating because of the resonant re-absorption of this wavelength by other mercury atoms. A reduction of efficiency is also likely if the power density of the discharge is significantly increased. Compaction of a lamp of given wattage can only be achieved therefore by bending the tube into a circle or by folding it back on itself so that several parallel discharge segments are in close proximity.

A variety of structures for achieving such a foreshortened fluorescent lamp have been described in the patent literature. For example, in H. G. Jenkins et al (U.S. Pat. No. 2,561,868) short segments of phosphor-coated glass tubing are enclosed in a larger common envelope with individual AC discharges in each inner tube. A parallel arrangement of discharges is described by M. Waly (U.S. Pat. No. 3,194,997) in which a glass separator consisting of three radial sections is loosely fit into a large diameter envelope to produce three 120° discharge zones between three pairs of electrodes on opposite ends of the device. A coaxial fluorescent light source is described by Campbell (U.S. Pat. Nos. 3,609,436 and 3,849,689) in which a discharge path extended from one end of a cylindrical lamp through an inner glass tube to its open end and back again between the inner tube and the outer jacket to one of several sequentially excited electrodes. In Campbell, it was found necessary to partially segregate the outer circumferential region by grooves on the inner tube so as to stabilize the discharge for each of the excited electrodes. A simpler design by Lauwerijssen (U.S. Pat. No. 4,142,125) uses an offset inner tube so that the return path of the discharge is at a fixed location. Only two electrodes are used in this lamp. More exotic designs utilize a convoluted tubular shape as in U.S. Pat. Nos. 4,300,073 and 4,337,414.

A need exists, therefore, for a compact fluorescent discharge lamp that is less expensive to produce and which gives efficient and uniform production of light. One of the problems with most of the present approaches is the complex grooved or finned glass structures required. These are expensive to fabricate and difficult to coat uniformly with phosphor. Another problem is the potential loss of visible light by absorption when a phosphor-lined internal discharge path is surrounded by outer phosphor-coated glass jackets through which the internally generated light must pass. A third problem involves the complexity required at both ends of the lamp caused by the multitude of heated filaments necessary to serve as electrodes when alternating current discharges are used.

DISCLOSURE OF THE INVENTION

According to the present invention, a fluorescent lamp is provided having a set of three direct-current low-pressure mercury discharges that are produced in a large diameter tube having an outer cylindrical glass envelope. At the base end of the lamp are located three alkaline earth-oxide-coated heated tungsten filaments which serve as cathode electrodes for supplying electron currents to ionize gas in the columns. The electron currents produce three plasma discharges effectively isolated from one another by three longitudinally extending semicircular glass partitions. A common electrode disk at the opposite end of the tube serves as the anode for all three plasma columns. Cathode leads extend through the base end of the discharge tube. A single anode lead is provided which extends up the center of the lamp tube to the anode within a thin glass insulator which is located between the three partitions. Phosphor coatings are applied to the inner concave surfaces of the partitions and to the inner surface of the outer glass envelope. The thickness of the coating on the outer glass envelope may be optimized to provide the most efficient production of light from the lamp.

Regions between pairs of partitions, as well as the central region do not become ionized because the current path is between the cathode and anode within each partition. These non-ionized regions are therefore termed inactive regions. These regions do contain the same inert gas plus mercury vapor fill, as does the entire volume within the outer glass envelope. As will be shown in detail in connection with the drawings, the above construction utilizes fewer electrodes and is easier to fabricate than prior art devices. Furthermore, as will be explained, the inactive regions facilitate use of direct current for producing the gaseous discharges.

BEST MODE OF CARRYING OUT THE INVENTION

Figure 1:
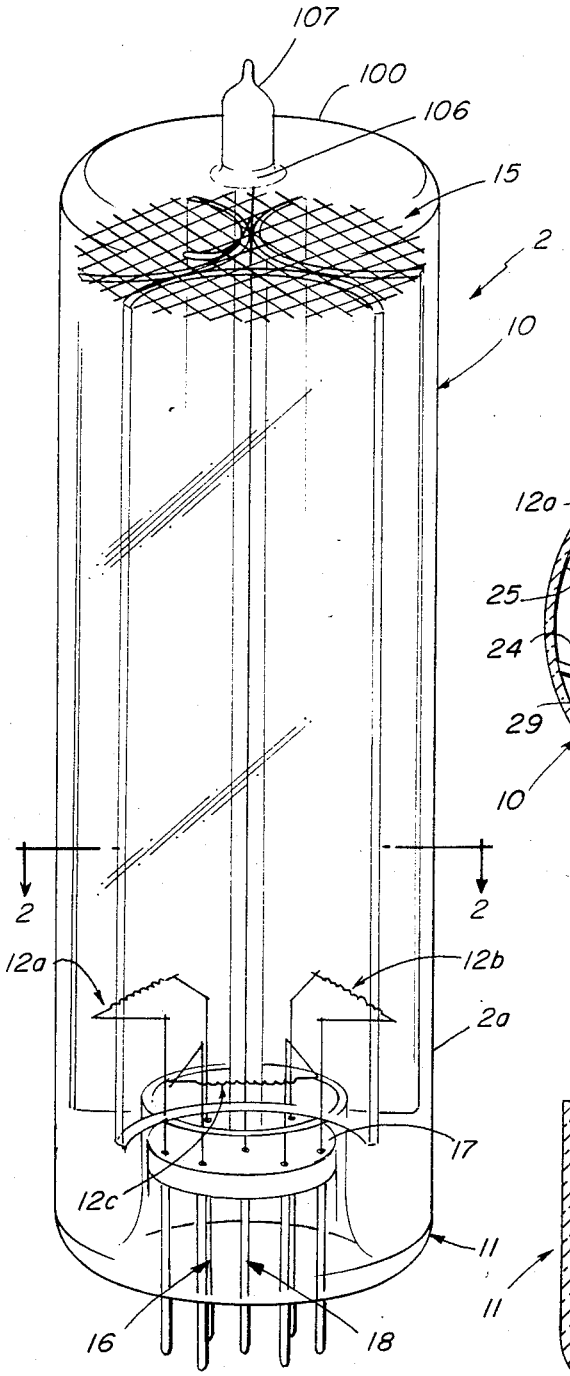
FIG. 1 is a perspective view showing the essential features of a first embodiment of the invention.
Figure 2:
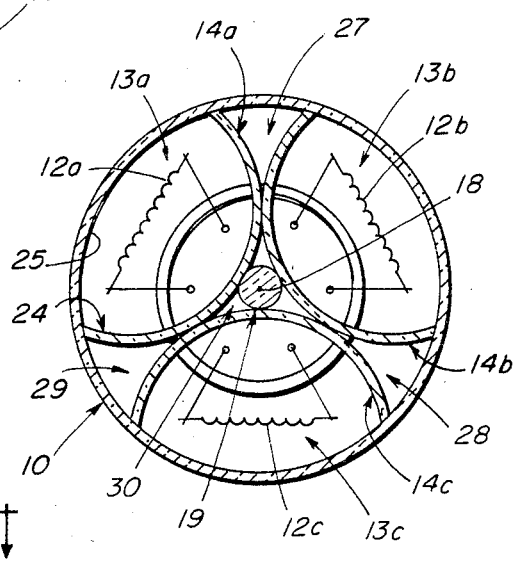
FIG. 2 is a section 2—2 through FIG. 1.
Figure 1A:
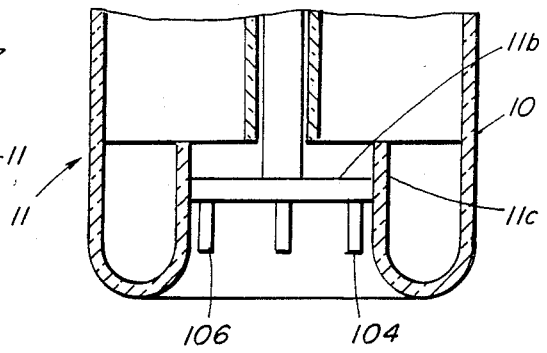
FIG. 1A is a section 1—1 showing the base end portion 11 of lamp 2.

Referring now to FIGS. 1 and 2, a first preferred embodiment of the invention is shown therein to comprise a fluorescent lamp 2 having a set of three direct-current low-pressure mercury discharges which are produced in a large diameter tube comprising an outer cylindrical envelope 10, a sealed top portion 100 and a closed base end 11. Base end 11 is formed by bending tubular portion 2*a* of envelope 10 back on itself forming a re-entrant circular opening which is closed by a circular sealing member 17. At the base end 11 of the lamp are located three alkaline earth-oxide-coated heated tungsten cathode filaments 12*a*, 12*b* and 12*c* for supplying electron current to plasma columns 13*a*, 13*b* and 13*c*. The plasma columns are effectively electrically isolated from one another by three semicircular glass partitions 14*a*, 14*b* and 14*c* which extend along the longitudinal axis of cylindrical envelope 10 and rest on top of re-entrant portion 11*c* of base end 11. The ends of glass partitions 14*a*, *b* and *c* abut the inner surface of cylindrical envelope 10 and are sealed thereto.

A common electrode disk 15 formed of iron sheet or mesh is located at the end of the tube opposite the base end. Disk 15 serves as the anode for all three plasma columns and need not be heated as are the cathodes 12*a*–12*c*. Six cathode leads 16 pass through the seal member 17 at the base end of the discharge tube 2. A single anode lead 18 runs up the center of the lamp through member 17 to the anode 15 within a thin glass insulator 19 which is located between partitions 14. Phosphor coatings 24 are applied to the concave surfaces of partitions 14 and an optional phosphor coating 25 is applied to the inner surface of the outer glass envelope 10.

Regions 27, 28 and 29 between pairs of partitions 14, as well as central region 30, are inactive in the respect that current is not conducted through these regions to create a plasma. They do, however, contain the same inert gas plus mercury vapor fill, as does the remaining entire volume within the glass envelope 10. A glass seal 106 and conventional evacuation port and tubulation is provided at the anode end of tube 10.

The lamp construction, above described, eliminates the need for a pressed glass part, as in the Waly patent supra. Instead, the partitions 14 can be made from standard 38 mm glass tubing by first scribing two opposing lines along the entire inner wall of a length of such tubing and coating the tube with phosphor using the standard coating machinery of present conventional lamp construction. The coated tube may then be split in two by subjecting its outer surface to a rapid heat cycle. Before the inner partitions 14 and cathode and anode electrodes are installed within the tube 10, the inner surfaces of the outer lamp envelope can also be easily coated with phosphor by any one of several standard techniques, such as electrostatic deposition. In this manner, the thickness of the two types of coating and the phosphors used can be individually optimized.

Another advantage of the present invention over that of Wally supra is the presence of unexcited regions 27 through 30. Such regions facilitate the use of direct current for the discharges. Operation of the lamp on direct current allows the use of a large area cold anode because it does not have to serve as a cathode as it would on the alternate half-cycles of an AC input. Also, since the current is constant, it can be optimized for maximum discharge efficiency. The one problem that can arise with DC operation is ion pumping of the $Hg+$ ions towards the cathode end of the discharge thereby depleting the mercury vapor concentration at the anode end. The inactive regions, however, provide a flow-back path around the plasma columns that minimizes such mercury depletion. During normal operation, therefore, the mercury content of the gas fill circulates downward toward the cathodes in the active discharge regions and returns to the anode end of the device along the non-ionized or unexcited paths in between the glass partitions.

Direct current operation of fluorescent lighting devices has not been used as extensively as the more common inductively ballasted AC mode of operation because of the $Hg+$ ion-pumping problem and because it is often assumed that inefficient resistive ballasting would be necessary. The ion-pumping problem is minimized as described above and the efficient ballasting of such lamps can be achieved through the use of an improved switching regulator, as will be described below.

Figure 3:
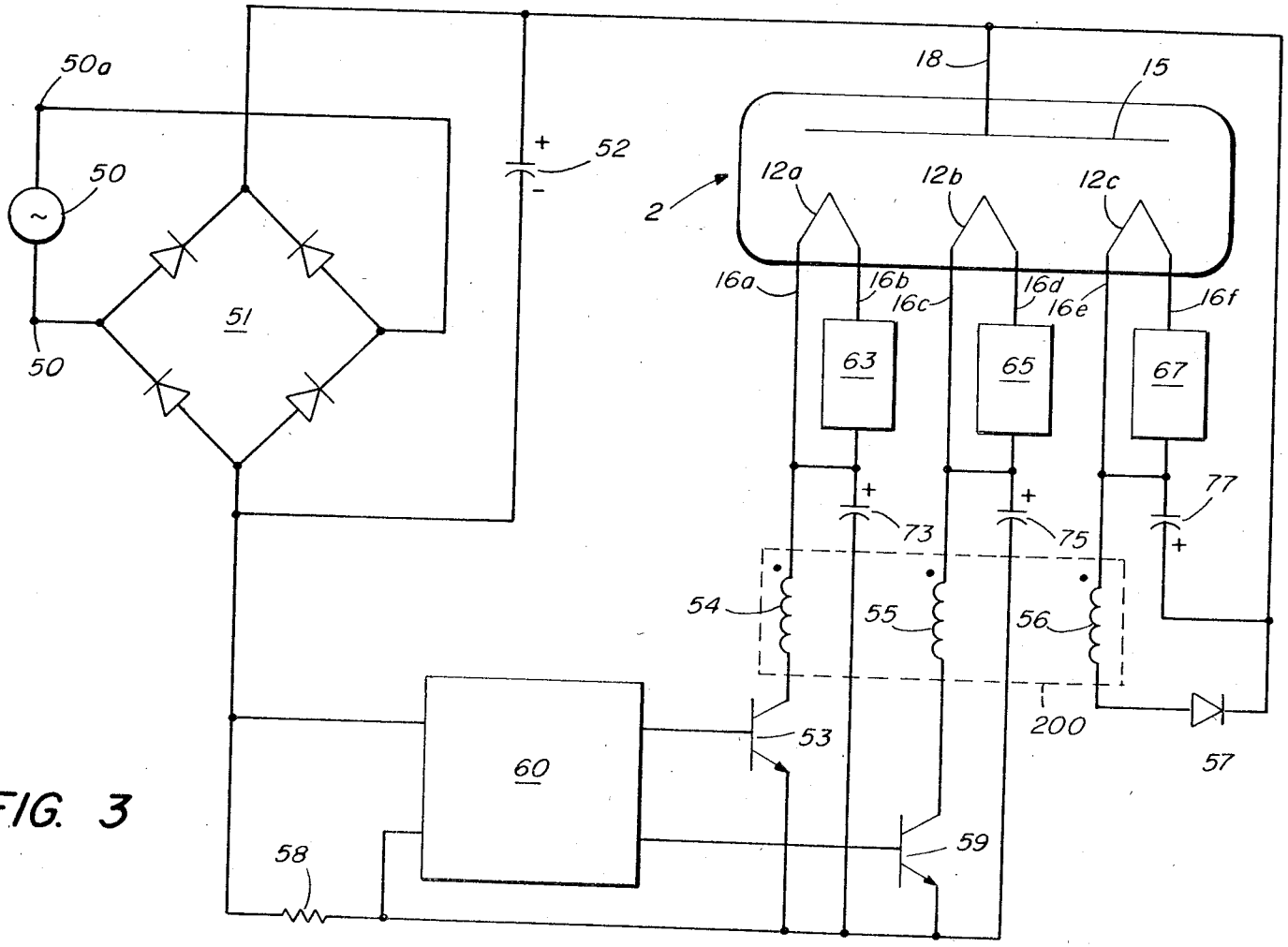
FIG. 3 is a schematic of a ballast power supply for the embodiment of FIG. 1.

A suitable ballast power supply for the DC fluorescent lamp 10 of FIGS. 1 and 2 is shown in schematic form in FIG. 3 in which like parts bear the same numeral reference. Lamp 10 has a single anode lead 18 and six cathode leads 16*a*–16*f*. Power is provided from an AC line voltage source 50 across input terminals 50*a* and 50*b*. The input AC voltage is rectified by a full wave bridge rectifier 51 and filtered by electrolytic capacitor 52. With 115 volts AC applied to rectifier 51, a filtered DC output of about 150 volts is provided across the lamp 2 and regulator ballast circuit. The cathodes 12*a*–*c* are heated by filament power supplies 63, 65 and 67 via leads 16*a*–16*f*. When the lamp 2 is operating at or near its nominal current through each discharge path, there is a constant voltage drop between each cathode and the common anode 15. This voltage drop should, for optimum operation, be $\frac{2}{3}$ of the DC voltage derived from the rectifier 51 and capacitor filter 52, or approximately 100 volts. This optimal voltage drop can be obtained by choosing the proper mercury buffer gas mixture in filling the lamp. Adding helium to the inert gas, argon or neon, generally used with the mercury allows the voltage to be raised to the required value. Capacitors 73 and 75, therefore, have across them the difference between the 150-volt supply and the 100-volt discharge through the lamp, or 50 volts. This voltage multiplied by the discharge currents represents power which is not dissipated but transferred to the third discharge circuit by means of the inductors 54, 55 and 56 which share a common magnetic core, represented by the dot symbol in the schematic. The inductors together with the core constitute a transformer 200 (shown in dotted lines) in which the primary windings are inductors 54 and 55 and the secondary winding is inductor 56. Power transfer is accomplished by means of switching transistors 53 and 59 controlled by switching control circuit 60.

The switching cycle operates at approximately 20 kHz, as follows:

First, transistor 53 is switched on for $\frac{1}{3}$ of the total switching cycle during which time current builds up in winding 54. Then for 1/6 of the cycle, both transistors 53 and 59 are switched off and the magnetic field in the transformer core collapses inducing a voltage of about 100 volts across secondary winding 56 which nominally has the same number of turns as windings 54 and 55. This induced voltage charges capacitor 77 through diode 57 to the nominal 100 volts across the discharge lamp. During the next $\frac{1}{3}$ cycle, transistor 59 is switched on and electromagnetic energy is stored via transformer winding 55. Finally, on the last 1/6 cycle, transistor 59 is switched off and the electromagnetic energy stored is transferred to capacitor 77 via winding 56 and diode 57.

Resistor 58 is connected in the current return path from the first two lamp discharge circuits. The DC current through the first two of the lamp discharge paths develops a small voltage drop through resister 58. This current is regulated by control circuit 60 which varies the fractional part of the switching cycle during which transistors 53 and 59 are conducting. Deviations from the nominal $\frac{1}{3}$ duty cycle are used to accommodate variations in line voltage and lamp voltage drop. The result of these deviations is a slow change in the relative currents in the three lamp discharges since the current passed on to the third discharge path via diode 57 represents the energy stored from the voltage differences between the supply 51 and the other two discharges. The result is an efficient powering of the DC fluorescent lamp from the power line. The only power lost is that dissipated in sensing resistor 58, in the imperfect switching action of transistors 53 and 59 and in the transformer coil resistances.

Equivalents

Figure 4:
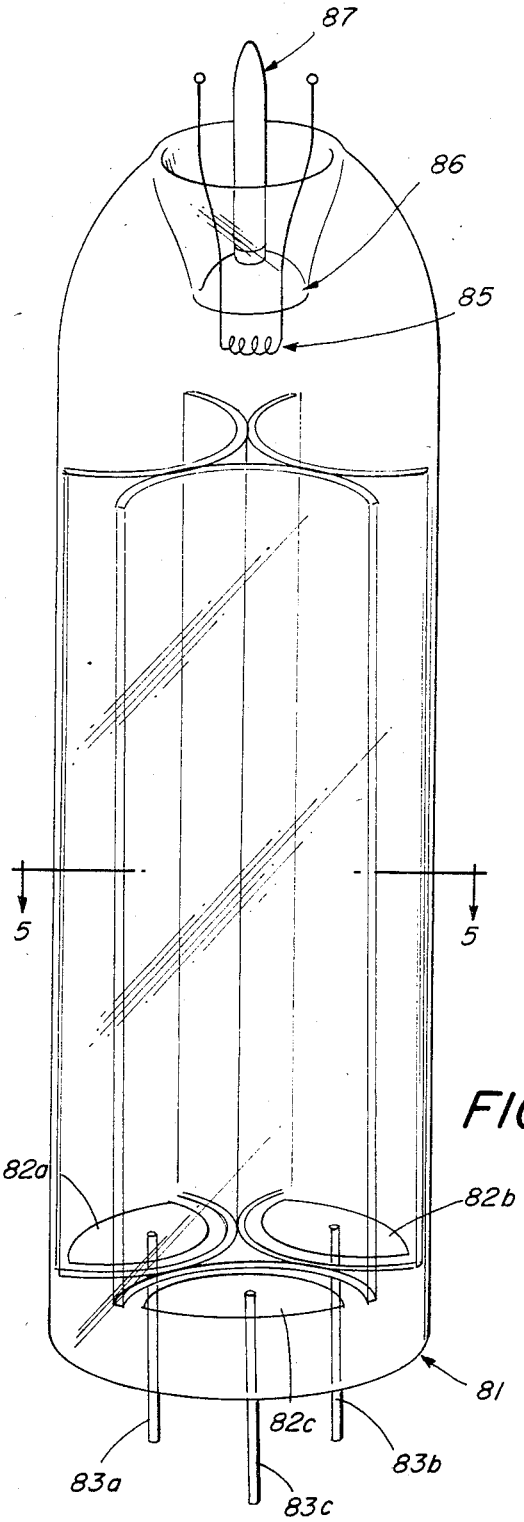
FIG. 4 is a perspective view of a further embodiment of the invention.
Figure 5:
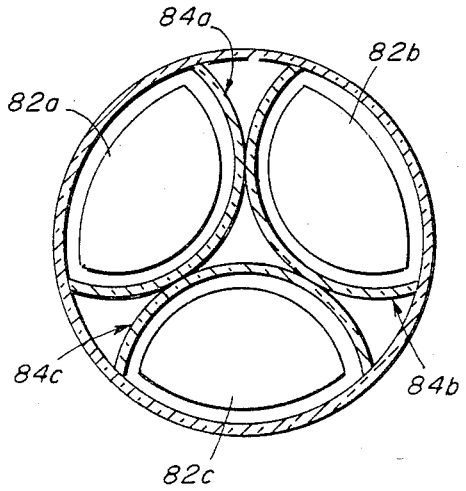
FIG. 5 is a section 5—5 through FIG. 4.

Referring now to FIGS. 4 and 5, an alternate embodiment will be described. The partitioned DC lamp of FIGS. 1 and 2 above described can also be constructed using a single cathode at one end and three separate anode plates at the opposite end of the discharge tube. Such a tri-anode construction consists of an outer jacket or envelope 81 with three semi-circular cylindrical partitions 84*a, b, c* formed as described in connection with FIGS. 1 and 2. Three anode plates 82*a,* 82*b* and 82*c* are located at one end of the tube within each of the three partitions and are oriented perpendicular to the tube axis. Separate current leads 83*a, b, c* are provided for each anode. A single heated cathode 85 consisting of a tungsten metal filament coated with alkaline earth oxides is located at the opposite end of the tube. The two cathode leads pass through glass seal 86 which also provides for the evacuation port and tubulation 87. Alternatively, the cathode leads may be led to the anode end of the lamp through an insulated sleeve, as in the case of the lamp of FIG. 1.

The power supply or ballast for this lamp is similar to that of FIG. 2, but three positive current sources of regulated current are required for the three anodes and only one cathode filament supply is needed.

While the above described embodiments represent preferred embodiments of the invention, modifications thereof will occur to those skilled in the art within the spirit and scope of the invention. Accordingly, the invention is not to be construed as limited thereto except as defined by the following claims:

I claim:

1. A lamp in which a gas is electrically discharged to produce light comprising:

a. a cylindrical envelope closed at both ends and having a coating of light emitting material on an inner surface and containing a gas;

b. a plurality of semi-circular partitions extending along a major longitudinal axis of said envelope and having light emitting coating on inner concave surfaces;

c. a plurality of electrodes, one each of such electrodes being located at one end of said partitions, said electrodes being electrically coupled to leads extending exterior to said envelope;

d. a single electrode adjacent to an end of said partitions opposite the end at which the plurality of electrodes are located and extending over all partitions and having a lead extending exterior to said envelope; and e. inactive regions between the outer surfaces of said partitions and the inner surface of said envelope and extending along the major longitudinal axis thereof in which no gaseous discharge occurs forming a flow back path between oppositely disposed electrodes for gas moved along the discharge path by current flow between electrodes.

2. The lamp of claim 1 in which N is the number of partitions and N is an integer equal to or greater than 2.

3. The lamp of claim 1 wherein the number of partitions is 3.

4. The lamp of claim 1 in which the plurality of electrodes are cathodes and the single electrode is an anode and the electrode lead from the anode is insulated and coupled along the central longitudinal axis of said cylinder and out the cathode end of the envelope.

5. The lamp of claim 4 in which the gas is a mixture of inert gases and vapor and the cathodes are alkaline earth-oxide-coated and heated tungsten filaments and the envelope and partitions are formed of glass and the coating is phosphor.

6. The lamp of claim 5 in which the plurality of electrodes are anodes and the single electrode is a cathode.

7. A fluorescent lamp including a low pressure mixture of an inert gas and an ionizable vapor therein, which vapor when ionized emits radiation which is absorbed by a fluorescent material in the lamp to produce visible light comprising:

a. a tubular glass envelope divided longitudinally into active regions by glass partitions of longitudinally extending semi-circular shape the inner concave surfaces of said partitions facing the inner concave surface of said envelope and the edges thereof abutting the inner surface of said envelope; the outer convex surfaces of the partitions defining an inactive region with the inner surface of said envelope between such partitions and in which the inactive regions form a path in which ionized vapors may be returned from one end of the active regions to the opposite end of the active regions;

b. a plurality of electrodes mounted at one end of said partitions and one electrode mounted at an opposite end of said partitions.

8. The fluorescent lamp of claim 7 in which the plurality of electrodes are cathodes and the one electrode is an anode.

9. The fluorescent lamp of claim 7 in which the plurality of electrodes are anodes and the one electrode is a cathode.

10. The lamp of claim 8 or 9 in which the plurality of electrodes are three or more in number.

11. A ballast power supply for a plural path discharge fluorescent lamp having a switching cycle of fixed time in which at least three heated cathodes are provided opposite a single anode comprising:

a. first and second inductors separately electrically coupled to one of two of the cathodes and forming the primary windings of a transformer;

b. the secondary of said transformer being formed by a third inductor electrically coupled to the third cathode;

c. each of said inductors sharing a common magnetic core;

d. a charging capacitor coupled on one side to said third inductor and on the remaining side to said anode.

e. switching means for enabling current to flow through the first inductor for a first one-third of said cycle, whereby a magnetic field is established in said core, and for the next one-sixth of the cycle discharging the magnetic field in said core which induces a voltage across the third inductor thereby charging the charging capacitor and for a second one-third of switching current through the second inductor to store magnetic energy in the transformer core and on the remaining one-sixth of the cycle discharging said magnetic energy to again charge said charging capacitor.

12. A lamp in which gas is electrically discharged to produce light comprising:

a. a cylindrical envelope closed at both ends;

b. three semi-circular partitions extending along a major longitudinal axis of said envelope;

c. three electrodes, one each of such electrodes being located at one end of said partitions, said electrodes being electrically coupled to leads extending exterior to said envelope;

d. a single electrode adjacent to an end of said partitions opposite the end at which the plurality of electrodes are located and extending over all partitions and having a lead extending exterior to said envelope;

e. inactive regions between the outer surfaces of said partitions and the inner surface of said envelope and extending along the major longitudinal axis thereof in which no gaseous discharge occurs;

f. a light emitting coating inside said envelope; and g. a power supply for supplying D.C. voltage across the single electrode and the plurality of electrodes, said power supply comprising:

(i) two inductors separately electrically coupled to two of the three electrodes and forming the primary windings of a transformer;

(ii) the secondary of said transformer being formed by a third inductor electrically coupled to the remaining third electrode;

(iii) each of said inductors sharing a common magnetic core;

(iv) switching means for enabling current to flow through the first of said two inductors for one-third of said cycle, whereby a magnetic field is stored in said core, and for one-sixth of the cycle discharging the magnetic field in said core to induce a voltage in the third inductor and for one-third of the cycle enabling current to flow through the second of said two inductors thereby to again store magnetic energy in the transformer core and on the remaining one-sixth of the cycle discharging said magnetic energy.

13. The lamp of claim 12 in which the three electrodes are cathodes and the single electrode is an anode.

14. The lamp of claim 12 including resistor means in the current path of the two inductors which is utilized in a central circuit to vary the fractional part of the switching cycle during which current is switched through the two inductors.

15. The power supply of claim 11 including resistor means in the current path of the two inductors which is utilized in a central circuit to vary the fractional part of the switching cycle during which current is switched through the two inductors.

* * * * *